US006106619A

United States Patent [19]

Eng

[11] Patent Number: 6,106,619

[45] Date of Patent: Aug. 22, 2000

[54] THERMALLY COMPENSATED COATER ROD

[75] Inventor: James A. Eng, Appleton, Wis.

[73] Assignee: Voith Sulzer Paper Technology North America, Inc., Appleton, Wis.

[21] Appl. No.: 09/047,768

[22] Filed: Mar. 25, 1998

[51] Int. Cl.[7] ..... B05C 3/02

[52] U.S. Cl. ..... 118/414; 118/262; 118/117; 118/118; 118/122; 118/123

[58] Field of Search ..... 492/46; 118/414, 118/117, 123, 118, 122, 262

[56] References Cited

U.S. PATENT DOCUMENTS 3,782,330 1/1974 Kande ..... 118/60

*Primary Examiner*—Brenda A. Lamb

*Attorney, Agent, or Firm*—Taylor & Aust, P.C.

[57] ABSTRACT

A coater for applying a coating medium to a moving surface includes a mounting; a coater rod bed connected to the mounting; and a coater rod carried by the coater rod bed. The coater rod is configured for applying the coating medium to the moving surface, and includes a hollow rod with a longitudinal bore interconnecting opposite ends thereof. A pair of fluid couplings are respectively attached to each end of the coater rod. Each fluid coupling has an internal fluid passage which is disposed in fluid communication with the longitudinal bore of the coater rod, whereby a thermal transfer fluid may be transported through the longitudinal bore of the coater rod.

12 Claims, 3 Drawing Sheets

THERMALLY COMPENSATED COATER ROD

BACKGROUND OF THE INVENTION

1. Field of the Invention

The present invention relates to a coater for applying a liquid or viscid medium to a moving surface (e.g., a fiber material web, applicator roll or backing roll), and, more particularly, to a coater for applying a coating mixture to a moving surface using a coater rod.

2. Description of the Related Art

A coater for applying a liquid or viscid medium (such as sizing) to a moving surface may include a coater rod which is positioned closely adjacent to the moving surface. The coater rod is driven in a rotational manner and the distance between the coater rod and the moving surface during operation determines the thickness of the coating which is applied to the moving surface. Typically, the coater rod is connected to a beam or mounting via a coater rod bed and a blade. The blade is flexible and allows the coater rod to be moved toward and away from the moving surface using known adjustment devices, such as profile adjusting screws and a load tube. The coater rod bed carries the coater rod and allows the coater rod to be rotatably driven therein.

Occasionally, it may be necessary to stop the operation of the coater, such as may occur during a sheet break of the fiber material web. During such periods of inoperation, the coater rod is typically not rotatably driven, but rather is stationary within the coater rod bed. The coater rod bed, being a relatively large mass relative to the coater rod, cools down from the operating temperature at a relatively slow cooling rate. The cooling rate is particularly slow if the coater rod bed is formed from a relatively poor thermally conductive material, such as polyurethane. On the other hand, the coater rod carried by the coater rod bed includes a portion of the periphery adjacent the moving surface which is exposed to both ambient air as well as possibly wash down water. It has been found by the present inventor that the coater rod may thermally distort by bowing away from the coater rod bed during periods of inoperation as a result of the coater rod being against the relatively hot coater rod bed on one side and cooler ambient air on the other side. After the coater is operated following a period of inoperation, the bowed coater rod results in an uneven coating application with a frequency which is dependent upon the rotational frequency of the coater rod. An uneven coating application caused by bowing of the coater rod is not desirable.

What is needed in the art is a coating machine having a coater rod which is not subject to thermal distortions.

SUMMARY OF THE INVENTION

The present invention provides a coater having a hollow coater rod and a thermal compensating system fluidly connected with the hollow rod and transporting a thermal transfer fluid through the hollow coater rod, thereby substantially preventing thermal distortions of the coater rod.

The invention comprises, in one form thereof, a coater for applying a coating medium to a moving surface. The coater includes a mounting; a coater rod bed connected to the mounting; and a coater rod carried by the coater rod bed. The coater rod is configured for applying the coating medium to the moving surface, and includes a hollow rod with a longitudinal bore interconnecting opposite ends thereof. A pair of fluid couplings are respectively attached to each end of the coater rod. Each fluid coupling has an internal fluid passage which is disposed in fluid communication with the longitudinal bore of the coater rod, whereby a thermal transfer fluid may be transported through the longitudinal bore of the coater rod.

An advantage of the present invention is that the coater rod is thermally compensated to substantially prevent thermal distortions thereof.

Another advantage is that the coater rod may be thermally compensated and rotated at the same time.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

3

Figure 3:
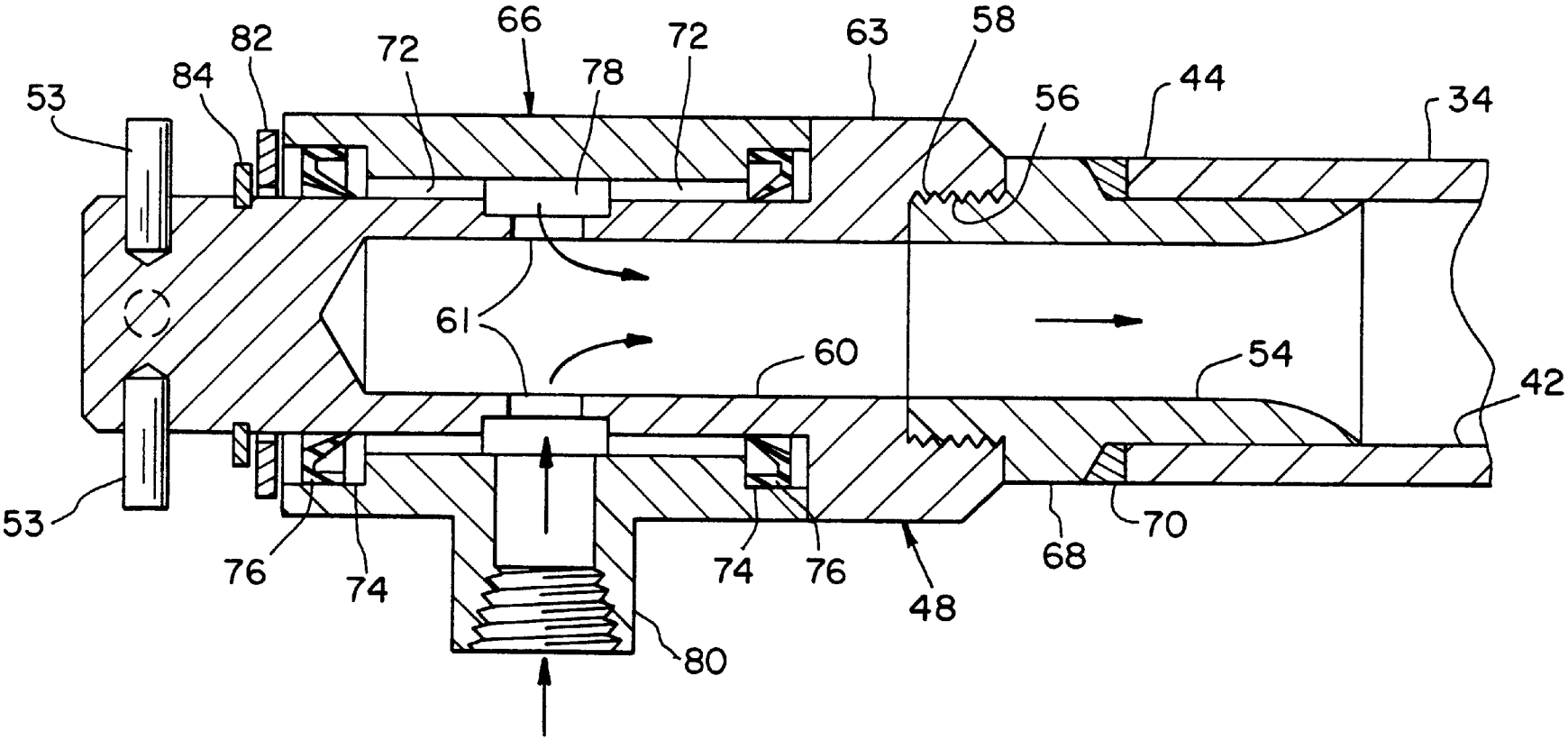

FIG. 3 is an enlarged, sectional view illustrating an embodiment of a fluid coupling and rotary drive unit of the present invention.

The exemplification set out herein illustrates one preferred embodiment of the invention, in one form, and such exemplification is not to be construed as limiting the scope of the invention in any manner.

DETAILED DESCRIPTION OF THE INVENTION

Figure 1:
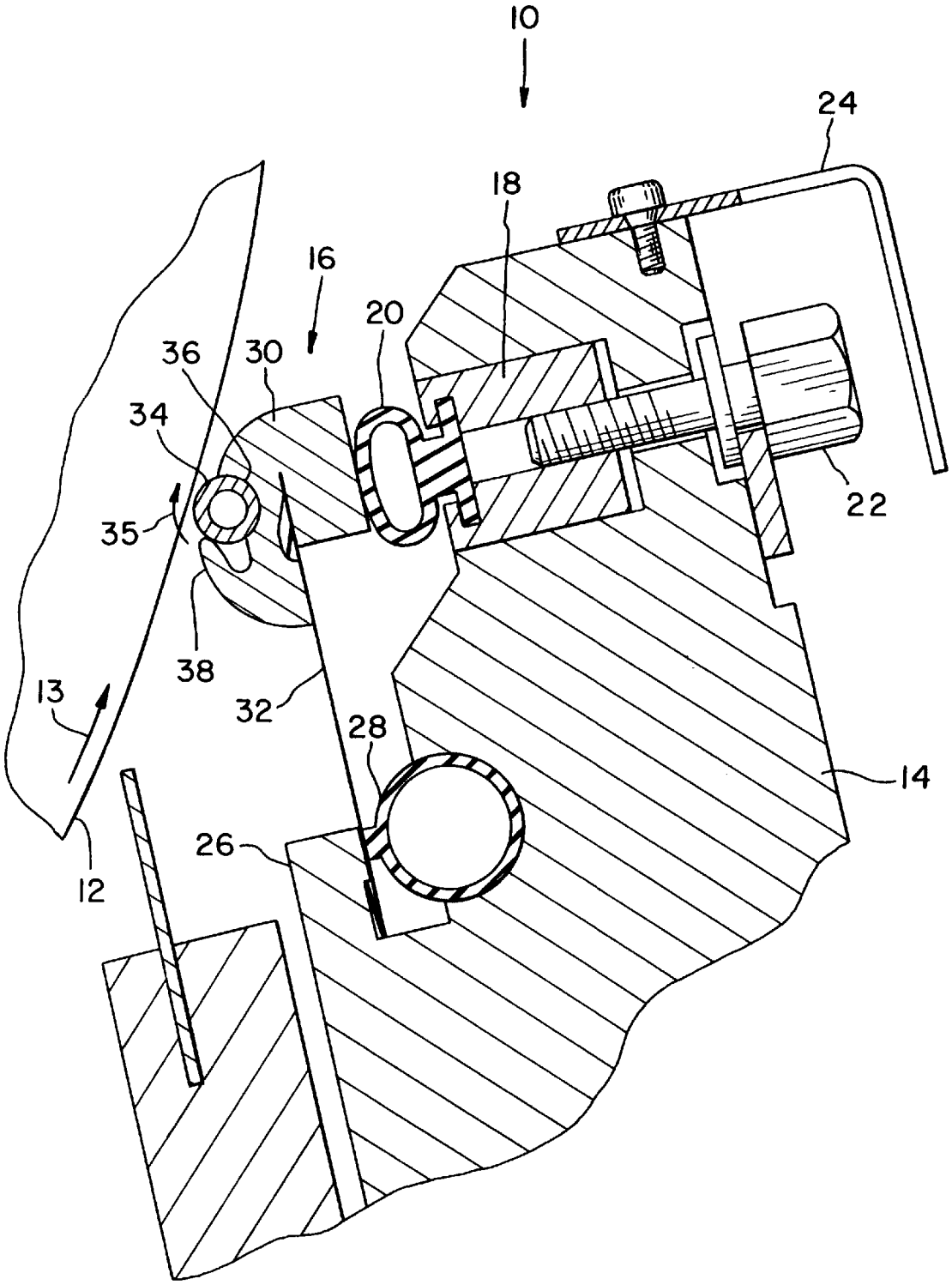
FIG. 1 is a side view of a coater assembly, including an embodiment of a coater rod of the present invention.

Referring now to the drawings, and more particularly to FIG. 1, there is shown an embodiment of a coater 10 which is used for applying a liquid or viscid coating medium onto a moving surface 12. Coater 10 generally includes a beam or mounting 14 and a coater rod assembly 16. Other parts making up coater 10 include a profile bar 18, a load tube 20, a plurality of profile adjustment screws (one of which is shown and referenced as 22), a cover 24, a blade support bar 26, and a blade clamping tube 28.

Moving surface 12, in the embodiment shown, is in the form of an applicator roll 12 which rotates in a counterclockwise direction as indicated by arrow 13. When configured as such, it is thus apparent to those skilled in the art that coater 10 applies the liquid or viscid medium (such as sizing) on a material web (such as paper or cardboard) in an indirect manner via an intermediate application of the medium on applicator roll 12. Moving surface 12 may also be in the form of a backing roll or a fiber web. If moving surface 12 is in the form of a fiber web, it will be appreciated by those skilled in the art that coater 10 carries out a direct application of the liquid or viscid medium on moving surface 12. Coater rod assembly 16 includes a coater rod bed 30 which is connected to mounting 14 via an elastic support element in the form of a blade 32. More particularly, blade 32 is clamped near one end thereof between blade clamping tube 28 and blade support bar 26. An opposing end of blade 32 is received within coater rod bed 30.

Coater rod assembly 16 also includes a coater rod 34 which is carried by coater rod bed 30 and configured for applying the coating medium onto moving surface 12. In the embodiment shown in FIG. 1, coater rod 34 has a substantially circular cross-section and is disposed adjacent to moving surface 12. Coater rod 34 extends in a direction corresponding to the width of moving surface 12 (i.e., generally perpendicular to the drawing plane of FIG. 1) and is driven in a rotational direction, as indicated by arrow 35. It will be appreciated that during operation a small gap likely exists between coater rod 34 and moving surface 12, dependent upon the thickness of the coating being applied.

In the embodiment shown, coater rod bed 30 includes a contoured surface 36 having a shape which is approximately the same as the peripheral shape of coater rod 34, and receives a portion of the periphery of coater rod 34 therein. Coater rod bed 30 also includes a hooked member 38 having a distal end which engages coater rod 34 and biases coater rod 34 against contoured surface 36.

Figure 2:
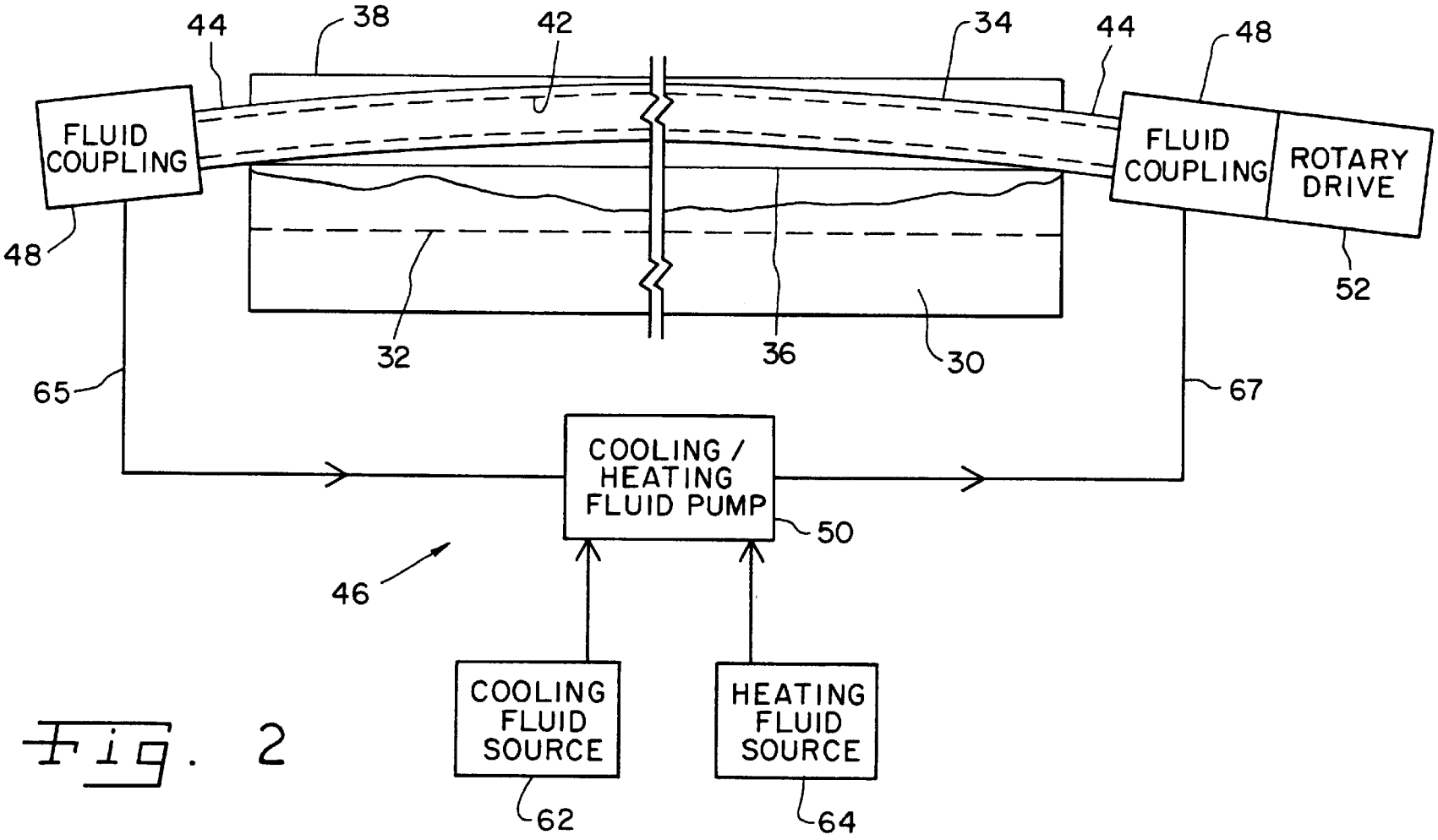
FIG. 2 is a simplified, fragmentary, top view of the coater rod and coater rod bed shown in FIG. 1, attached to an embodiment of a thermal compensating system of the present invention.

According to the present invention, coater rod 34 is a hollow rod with a longitudinal bore 42 therein. Longitudinal bore 42 extends between and interconnects opposite ends 44 of coater rod 34 (FIG. 2). A thermal compensating system 46, including a pair of fluid couplings 48, a cooling/heating fluid pump 50 and at least one rotary drive unit 52, is connected and disposed in fluid communication with longitudinal bore 42 of coater rod 34. Thermal compensating system 46 is configured for transporting a thermal transfer fluid, such as a cooling fluid or heating fluid, through longitudinal bore 42 of coater rod 34 and thereby substantially prevents thermal distortion of coater rod 34. Thermal compensating system 46 thus substantially prevents bowing of coater rod 34 in a radial direction which may occur during periods of inoperation of coater 10 when coater rod 34 is not rotating. Coater rod 34 is shown in an exaggerated bowed state in FIG. 2 for purposes of illustration.

Fluid couplings 48 are each attached to a respective end 44 of coater rod 34 in a substantially sealed manner. More particularly, as shown in FIG. 3, an adapter 68 having an internal fluid passage 54 is attached to each end 44 of coater rod 34 via a weld 70. Adapter 68 has an externally threaded portion 56 which is threadingly engaged with a corresponding internally threaded portion 58 of an extension 63 of a fluid coupling 48. An internal fluid passage 60 is disposed radially within internally threaded portion 58 of extension 63 and in fluid communication with longitudinal bore 42 of coater rod 34. Fluid coupling 48 includes a plurality of radially extending ports 61 spaced around an inside diameter thereof which are in fluid communication with a respective fluid line 65 or 67 (FIG. 2). Each internal fluid passage 60 is disposed in fluid communication with cooling/heating fluid pump 50, indicated schematically by lines 65 and 67 in FIG. 2, thereby defining a closed loop system for selectively transporting a cooling fluid or a heating fluid through longitudinal bore 42 of coater rod 34. Cooling/heating fluid pump 50 is connected with a source of cooling fluid 62 and/or a source of heating fluid 64 for selectively transporting a cooling fluid and/or heating fluid through longitudinal bore 42 of coater rod 34.

Each fluid coupling 48, in the embodiment shown, also includes a rotary joint 66 which is formed integrally therewith. Rotary joint 66 allows coater rod 34 to be driven in a rotational manner, while at the same time allowing substantially sealed fluid interconnection between longitudinal bore 42 and internal fluid passage 60. Each rotary joint 66 includes a bushing 72 which is positioned radially around extension 63. Bushing 72 maintains rotary joint 66 in a spaced apart relationship relative to extension 63, and thereby define an annular channel 78 between rotary joint 66 and extension 63 allowing the heating or cooling fluid to flow therethrough to ports 61. Rotary joint 66 also has a pair of annular grooves 74 on opposite ends at the inside diameter thereof. Each annular groove 74 is configured to receive a corresponding seal 76 therein which provides a fluid seal between extension 63 and rotary joint 66. A fluid fitting 80 extends from bushing 72 and allows interconnection with a fluid line 65 or 67. In the embodiment shown, fluid fitting 80 is internally threaded to mate with corresponding external threads on a fluid line 65 or 67. A washer 82 and retainer ring 84 are positioned at an axial end of rotary joint 66 and maintain rotary joint 66 at a proper location relative to extension 63. It is thus apparent by the foregoing description of rotary joint 66 that when fluid fitting 80 is connected with a fluid line 65 or 67, rotary joint 66 does not rotate while extension 63 is rotatably driven therein. Bushing 72 is preferably formed from a bronze material because of the reduced corrosion and friction properties associated therewith.

Rotary drive unit 52 is connected with coater rod 34 and a rotary joint 66 of a fluid coupling 48. Rotary drive unit 52 rotatably drives coater rod 34 through a quick connect arrangement in the form of a female coupling which mates with four pins 53 which radially extend from an end of fluid coupling 48, two of which are visible in FIG. 3. In the embodiment shown, rotary drive unit 52 is in the form of an electric motor which drives a corresponding coater rod 34. However, it is to be appreciated that rotary drive unit 52 may be in the form of any convenient power source, such as a belt driven power source or a fluid driven power source.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims

What is claimed is:

1. A coater for applying a coating medium onto a moving surface, said coater comprising:

a mounting;

a coater rod bed connected to said mounting:

a coater rod carried by said coater rod bed and configured for applying the coating medium to the moving surface, said coater rod comprising a hollow rod with a longitudinal bore interconnecting opposite ends thereof; and a pair of fluid couplings respectively attached to each said end of said coater rod, each said fluid coupling having an internal fluid passage which is disposed in fluid communication with said longitudinal bore of said coater rod, whereby a thermal transfer fluid may be transported through said longitudinal bore of said coater rod, said longitudinal bore, said thermal transfer fluid, and said fluid couplings conjunctively defining a means to prevent thermal distortion of said coater rod.

2. The coater of claim 1, further comprising a pair of rotary joints, each said rotary joint being one of integral with and attached to a respective one of said fluid couplings.

3. The coater of claim 2, further comprising a rotary drive unit connected to said coater rod for rotatably driving said coater rod.

4. The coater of claim 1, wherein said fluid joints are configured for transporting one of a cooling fluid and heating fluid through said longitudinal bore of said coater rod.

5. The coater of claim 1, further comprising an elastic support element interconnecting said coater rod bed with said mounting.

6. The coater of claim 5, wherein said elastic support element comprises a blade.

7. The coater of claim 1, wherein the moving surface comprises an applicator roll.

8. The coater of claim 1, wherein said coater rod has a substantially circular cross-section.

9. A coater for applying a coating medium onto a moving surface, said coater comprising:

a mounting;

a coater rod bed connected to said mounting;

a coater rod carried by said coater rod bed and configured for applying the coating medium to the moving surface, said coater rod comprising a hollow rod with a longitudinal bore interconnecting opposite ends thereof; and a thermal compensating means for substantially preventing thermal distortion of said coater rod, said thermal compensating means being connected and disposed in fluid communication with said longitudinal bore of said coater rod, said thermal compensating means comprising a thermal transfer fluid transported through said longitudinal bore of said coater rod.

10. The coater of claim 9, wherein said thermal distortion comprises bowing of said coater rod in a radial direction.

11. The coater of claim 9, wherein said thermal compensating means comprises:

a pair of fluid couplings respectively attached to each said end of said coater rod, each said fluid coupling having an internal fluid passage which is disposed in fluid communication with said longitudinal bore of said coater rod, whereby a thermal transfer fluid may be transported through said longitudinal bore of said coater rod; and a rotary drive unit connected to said coater rod for rotatably driving said coater rod.

12. The coater of claim 9, further comprising a pair of rotary joints, each said rotary joint being one of integral with and attached to a respective one of said fluid couplings.

* * * * *

UNITED STATES PATENT AND TRADEMARK OFFICE

CERTIFICATE OF CORRECTION

PATENT NO. : 6,106,619

DATED : August 22, 2000

INVENTOR(S) : James A. Eng

It is certified that error appears in the above-identified patent and that said Letters Patent is hereby corrected as shown below:

COLUMN 2

Line 25, delete "3".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*